US007121878B2

(12) United States Patent
Chang et al.

(10) Patent No.: US 7,121,878 B2
(45) Date of Patent: Oct. 17, 2006

(54) VIBRATION RESISTANT CONNECTOR

(75) Inventors: Wang Kuo Chang, Tucheng (TW); Yani Yin, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/072,443

(22) Filed: Mar. 7, 2005

(65) Prior Publication Data

US 2006/0199429 A1 Sep. 7, 2006

(51) Int. Cl.
*H01R 13/73* (2006.01)

(52) U.S. Cl. ..... 439/564

(58) Field of Classification Search ..... 439/564, 439/565, 566, 562, 563, 557, 552, 558, 536, 439/545, 384

See application file for complete search history.

(56) References Cited

U.S. PATENT DOCUMENTS 3,363,218 A * 1/1968 Breivogel ..... 439/384
4,073,563 A * 2/1978 Bailey et al. ..... 439/532
4,824,398 A * 4/1989 Taylor ..... 439/557
5,320,554 A * 6/1994 Freer et al. ..... 439/347
6,231,384 B1 * 5/2001 Kuo ..... 439/545
6,875,052 B1 * 4/2005 Lo et al. ..... 439/564
6,921,292 B1 * 7/2005 Miyazaki ..... 439/564

* cited by examiner

*Primary Examiner*—Phuong Dinh
(74) *Attorney, Agent, or Firm*—Rosenberg, Klein & Lee

(57) ABSTRACT

A vibration resistant connector is disclosed which includes an insulating body with two juxtaposed cavities extending through the middle of the insulating body for holding a plurality of conductive terminals, and a fixing sheet secured on the insulating body. The fixing sheet has a base portion which is secured on the insulating body, two connecting portions extending from two opposite ends of the base portion respectively with a certain angle formed between each connecting portion and the base portion, and two fixing portions extending from the free ends of the corresponding connecting portions respectively with parallel to the base portion for securing the connector on an electrical device.

5 Claims, 5 Drawing Sheets

VIBRATION RESISTANT CONNECTOR

FIELD OF THE INVENTION

The present invention generally relates to an electrical connector, and more particularly, to a vibration resistant connector.

THE RELATED ART

In order to secure a connector on an electronic equipment such as a computer, the connector is often provided with a fixing mechanism. In T.W. Pat. No. 515588 issued on Dec. 21, 2002, a connector with a fixing mechanism is provided which is secured on an inner frame of a computer. The typical connector includes two juxtaposed plugs and a housing abutting the fixing mechanism. The housing has a top cover and a bottom cover engaging with the top cover, with a space defined therein for holding the plugs. The fixing mechanism is made of a flat and rigid metal sheet, so unable to absorb or reduce the vibration on the connector caused by outer force, and as a result, the signal can't be transferred stably. A slot is offered in the middle of the fixing mechanism for the front portions of the plugs passing through to electrically contact with a complementary receptacle. The fixing mechanism is further provided with two fixing openings formed respectively at two opposite sides of the slot. The housing is further provided with two protrusions extending respectively from opposite sides thereof, with each protrusion defining a through-hole therein corresponding to the fixing opening of the fixing mechanism. Conventional fixing members, such as a pair of bolts or the like, are used to pass through the corresponding through-holes of the housing and the corresponding fixing openings of the fixing mechanism in turn respectively for connecting the housing with the fixing mechanism, and then securing the combination of the housing and the fixing mechanism to the inner frame of the computer. Hence, the conventional connector as above mentioned has relatively many elements, and this results in a complicated structure with troublesome assembling.

SUMMARY OF THE INVENTION

An objective of the present invention is to provide a connector which not only can decrease the influence of vibration, but also has a simple structure and is easy to assemble.

To achieve the above objective, the present invention provides a vibration resistant connector which includes an insulating body with at least one cavity extending through the middle of the insulating body for holding a plurality of conductive terminals, and a fixing sheet secured on the insulating body. The fixing sheet has a base portion which is secured on the insulating body, two connecting portions extending from two opposite ends of the base portion respectively with a certain angle formed between each connecting portion and the base portion, and two fixing portions extending from the free ends of the corresponding connecting portions respectively with parallel to the base portion for securing the connector on an electrical device.

In addition, the insulating body includes a base stage and a platform extending from the front surface of the base stage. The vibration resistant connector in accordance with the present invention is further provided with at least one limiting block and at least one fixing block are arranged on the top and bottom surfaces of the platform for securing the fixing sheet on the insulating body, with a distance corresponding to thickness of the fixing sheet formed between the fixing blocks and the base stage. The top surface of the fixing block is defined as a ramp for guiding the fixing sheet to be trapped between the fixing block and the base stage. Correspondingly, the fixing sheet has a slot defined in the middle of the base portion thereof for mating with the platform of the insulating body, and at least one opening which is defined on the top and bottom of the slot and communicates with the slot for mating with the corresponding limiting block.

Alternatively, the vibration resistant connector in accordance with the present invention is provided with the base portion of the fixing sheet secured integrally on the insulating body by means of insert molding.

According to the foregoing description, the connecting portions of the fixing sheet make the base portion integrated with the insulating body of the connector and the fixing portions disposed in two separated parallels with a certain angle formed between the connecting portions and the base portion, so as to provide the connector enough resilience to absorb the vibration, and thus the vibration resistant function of the connector is achieved to prevent the connector from being damaged by the outer force. Besides, the fixing sheet is secured on the insulating body by the limiting blocks and the fixing blocks being arranged on the platform of the insulating body or by means of insert molding, therefore the structure of the vibration resistant connector is simple and the assembly of the vibration resistant connector is easy.

BRIEF DESCRIPTION OF THE DRAWINGS

The present invention will be apparent to those skilled in the art by reading the following description of embodiments thereof, with reference to the attached drawings, in which.

DETAILED DESCRIPTION OF THE PREFERRED EMBODIMENTS

Figure 1:
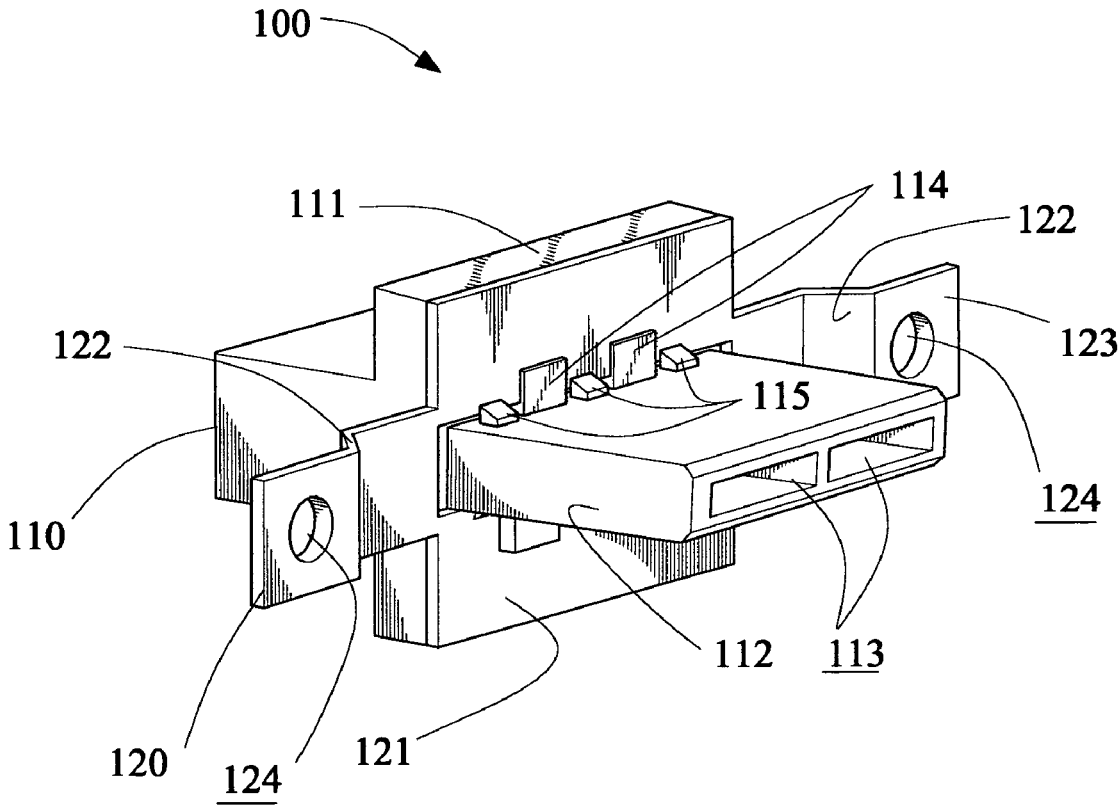
FIG. 1 is a perspective view of a first embodiment of the vibration resistant connector according to the present invention.

With reference to FIG. 1, a first embodiment of the vibration resistant connector 100 according with the present invention is disclosed. The vibration resistant connector 100 includes an insulating body 110 and a fixing sheet 120 secured on the insulating body 110. The insulating body 110 defines at least one cavity for holding a plurality of conductive terminals (not shown in FIGS), and the fixing sheet 120 is made of a metal or plastics.

Figure 2:
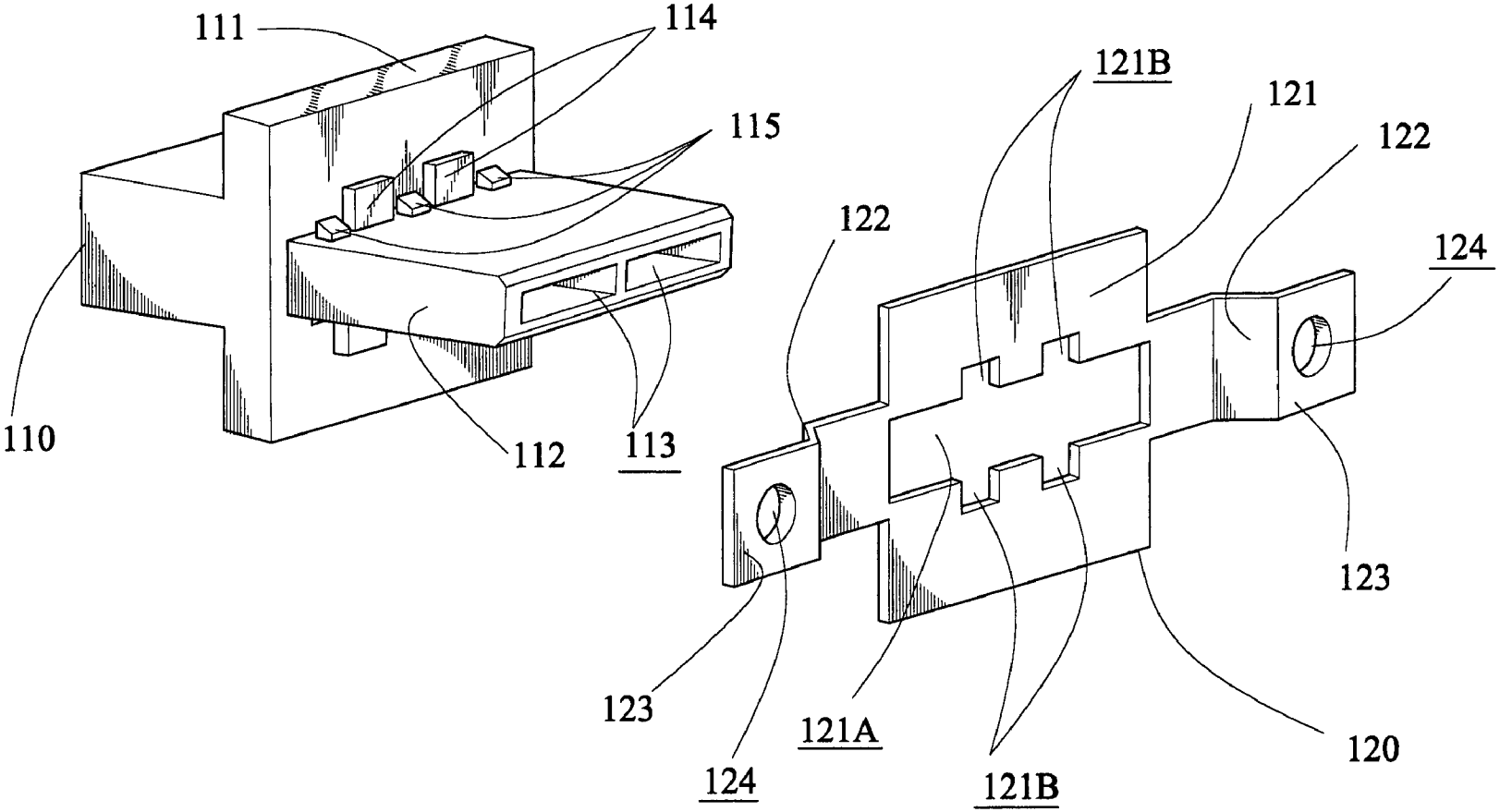
FIG. 2 is an exploded perspective view of the vibration resistant connector shown in FIG. 1.
Figure 3:
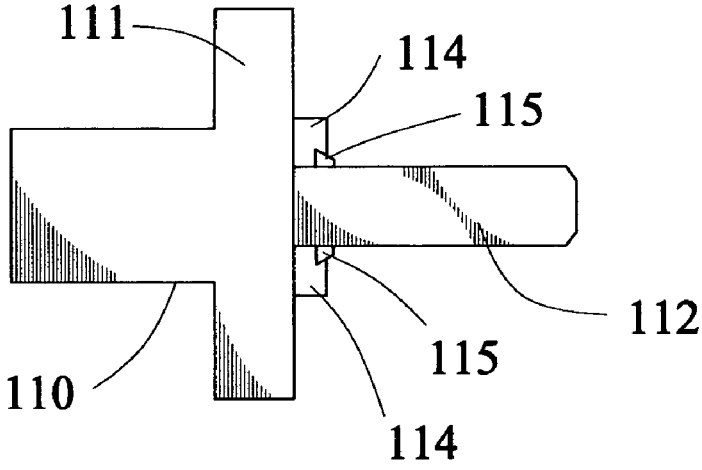
FIG. 3 is a left side view of the vibration resistant connector shown in FIG. 2.

With reference to FIG. 2 and FIG. 3, the insulating body 110 includes a base stage 111 and a platform 112 extending from the front surface of the base stage 111. In this embodiment, the insulating body 110 defines two juxtaposed cavities 113 extending through the middle thereof for holding the corresponding conductive terminals. Two limiting blocks 114 and three fixing blocks 115 are arranged alternately on the top and bottom surfaces of the platform 112. Each limiting block 114 is shaped into a rectangle and integrated with the base stage 111. The fixing blocks 115 are separated from the base stage 111 as shown in FIG. 3, with a distance corresponding to the thickness of the fixing sheet 120 between the fixing blocks 115 and the base stage 111. The top surface of each fixing block 115 is a ramp that is used to guide the fixing sheet 120 to be trapped between the fixing block 115 and the base stage 111.

The fixing sheet 120 has a base portion 121, with a slot 121A defined in the middle of the base portion 121 for mating with the platform 112 of the insulating body 110, and two openings 121B which are defined on the top and bottom of the slot 121A and communicate with the slot 121A for mating with the corresponding limiting blocks 114 respectively. A connecting portion 122 extends from each of two opposite ends of the base portion 121, with a certain angle formed between the connecting portion 122 and the base portion 121. A fixing portion 123 extends from the free end of each connecting portion 122 and is parallel with the base portion 121. Thus, each connecting portion 122 makes the base portion 121 and the corresponding fixing portion 123 disposed in two separated parallels. Therefore, the fixing sheet 120 can absorb vibration, and as a result, the vibration resistant function of the connector 100 is achieved. Furthermore, there is a fixing hole 124 defined in each fixing portion 123 for a bolt or a screw passing through to fixing the vibration resistant connector 100 on an electrical device.

In assembling, the platform 112 of the insulating body 110 passes through the slot 121A in the base portion 121 of the fixing sheet 120, then the top surfaces of the fixing blocks 115 on the platform 112 push the top or bottom edge of the slot 121A correspondingly and urge the fixing sheet 120 to deform, therefore the width of the slot 121A becomes large little by little. After the fixing blocks 115 passing through the slot 121A completely, the fixing sheet 120 elastically recovers its original shape and then is secured between the fixing blocks 115 and the base stage 111. At the same time, each of the limiting blocks 114 mates with the corresponding opening 121B to prevent the fixing sheet 120 from shifting, and as a result, the fixing sheet 120 is secured on the insulating body 110 stably. According to the mentioned above, the vibration resistant connector 100 has a simple structure and is easy to assemble.

Figure 4:
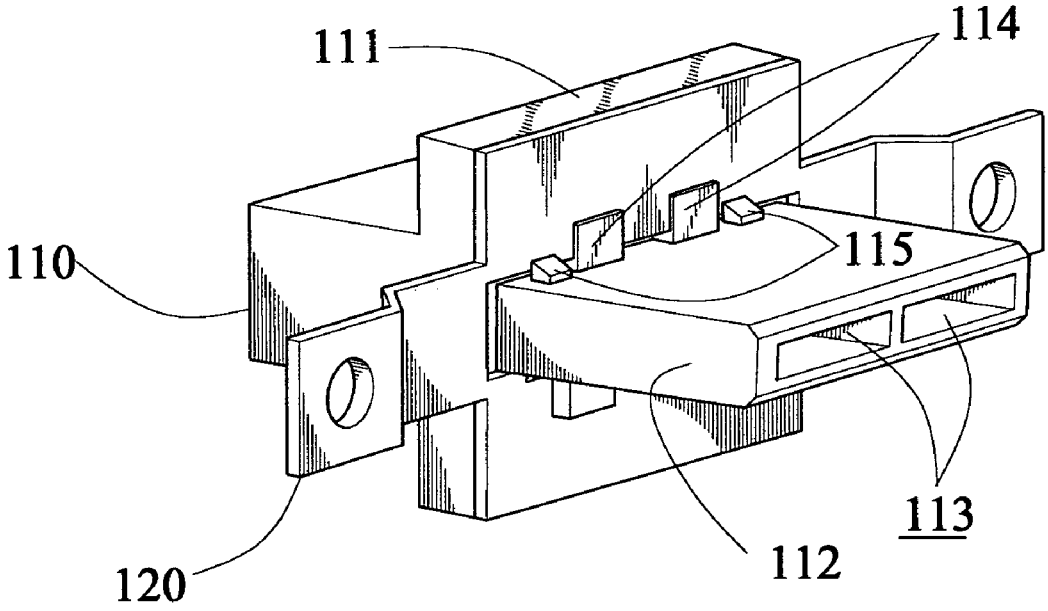
FIG. 4 is a perspective view of a second embodiment of the vibration resistant connector according to the present invention.

With reference to FIG. 4 again, a second embodiment of the vibration resistant connector 100 is shown. In this embodiment, the vibration resistant connector 100 is similar to that shown in the first embodiment, and the difference from the first embodiment is: two limiting blocks 114 and two fixing blocks 115 are provided on the top and bottom surfaces of the platform 112, and the limiting blocks 114 are arranged between the fixing blocks 115.

Figure 5:
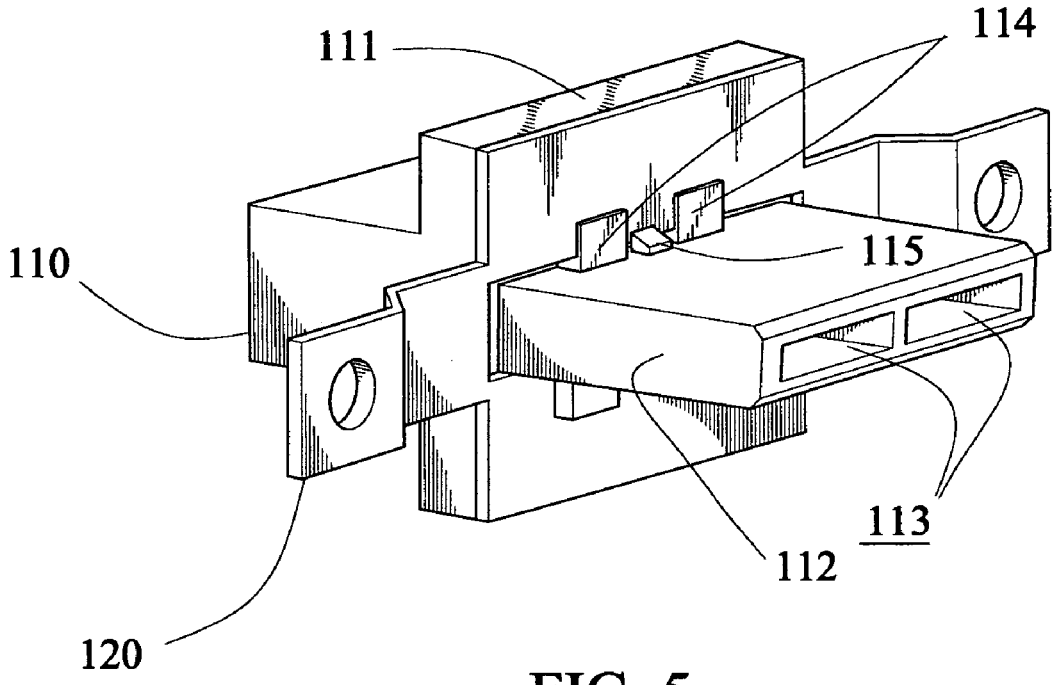
FIG. 5 is a perspective view of a third embodiment of the vibration resistant connector according to the present invention.

With reference to FIG. 5, a third embodiment of the vibration resistant connector 100 is shown. In this embodiment, the vibration resistant connector 100 is similar to that shown in the first embodiment, and the difference from the first embodiment is: two limiting blocks 114 and one fixing block 115 are provided on the top and bottom surfaces of the platform 112, and the limiting blocks 114 and the fixing block 115 are arranged alternately.

Figure 6:
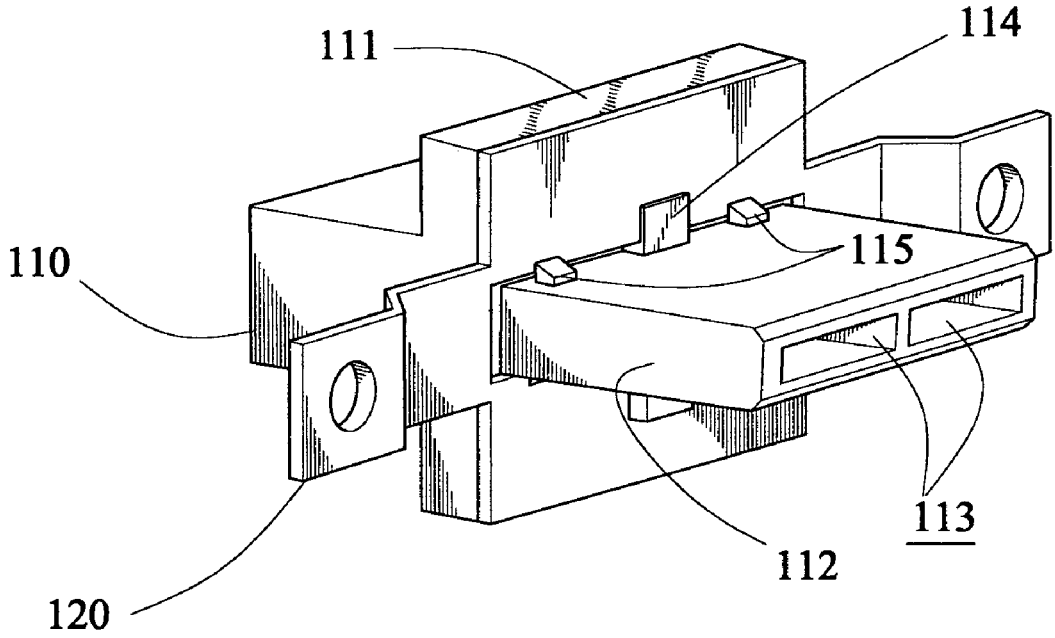
FIG. 6 is a perspective view of a forth embodiment of the vibration resistant connector according to the present invention.

With reference to FIG. 6, a forth embodiment of the vibration resistant connector 100 is shown. In this embodiment, the vibration resistant connector 100 is similar to that shown in the first embodiment, and the difference from the first embodiment is: one limiting block 114 and two fixing blocks 115 are provided on the top and bottom surfaces of the platform 112, and the limiting block 114 and the fixing blocks 115 are arranged alternately.

As will be apparent to those skilled in the art, the amount of the limiting blocks 114 and the fixing blocks 115 may be set according to individual requirements, Only if the fixing sheet 120 is secured on the insulating body 110 stably, the equivalent alterations and modifications are possible in the practice of this invention.

Figure 7:
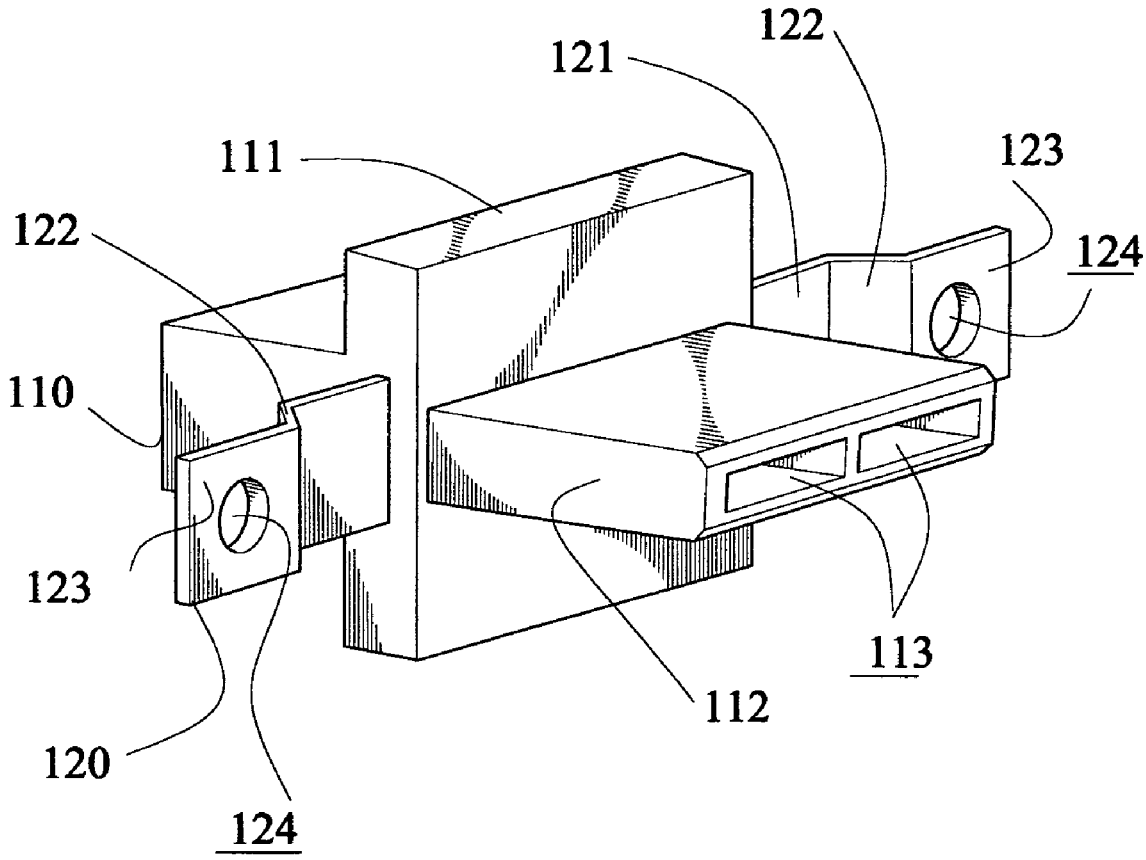
FIG. 7 is a perspective view of a fifth embodiment of the vibration resistant connector according to the present invention.

With reference to FIG. 7 again, a fifth embodiment of the vibration resistant connector 100 is shown. In this embodiment, the vibration resistant connector 100 is similar to that shown in the first embodiment, and the difference from the first embodiment is: the fixing sheet 120 is secured integrally on the insulating body 110 by means of insert molding. Besides, the limiting blocks and the fixing blocks are omitted in this embodiment, hence the structure of the vibration resistant connector 100 is simpler and the assembly is easier.

What is claimed is:

1. A vibration resistant connector comprising:

an insulating body with at least one cavity extending through the middle of the insulating body for holding a plurality of conductive terminals, the insulating body including a base stage and a platform extending from a front surface of the base stage; and a fixing sheet being secured on the insulating body;

wherein the fixing sheet has a base portion which is secured on the insulating body, two connecting portions extending from two opposite ends of the base portion respectively with a certain angle formed between each connecting portion and the base portion, and two fixing portions extending from the free ends of the corresponding connecting portions respectively and arranged in parallel relationship with respect to the base portion, at least one limiting block and at least one fixing block being arranged on a top surface and a bottom surface of the platform for securing the fixing sheet on the insulating body, with a distance corresponding to a thickness of the fixing sheet formed between the fixing block and the base stage, and a top surface of the fixing block being defined as a ramp for guiding the fixing sheet to be trapped between the fixing block and the base stage; and the fixing sheet having a slot defined in a middle portion of the base portion thereof for mating with the platform of the insulating body, with at least one opening defined on a top and a bottom of the slot and communicating with the slot for mating with the corresponding limiting block.

2. The vibration resistant connector as claimed in claim 1, wherein there are two limiting blocks and three fixing blocks, which are arranged alternately on the top and bottom surfaces of the platform.

3. The vibration resistant connector as claimed in claim 1, wherein there are two fixing blocks and two limiting blocks arranged between the fixing blocks, which are disposed on the top and bottom surfaces of the platform.

4. The vibration resistant connector as claimed in claim 1, wherein there are one limiting block and two fixing blocks, which are arranged alternately on the top and bottom surfaces of the platform.

5. The vibration resistant connector as claimed in claim 1, wherein there are two limiting blocks and one fixing block, which are arranged alternately on the top and bottom surfaces of the platform.

* * * * *